US009140101B2

(12) United States Patent
Scott et al.

(10) Patent No.: US 9,140,101 B2
(45) Date of Patent: Sep. 22, 2015

(54) SUBSURFACE SAFETY VALVE DEPLOYABLE VIA ELECTRIC SUBMERSIBLE PUMP

(75) Inventors: Bruce Edward Scott, McKinney, TX (US); James Dan Vick, Jr., Dallas, TX (US); Jimmie Robert Williamson, Jr., Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 370 days.

(21) Appl. No.: 13/703,953

(22) PCT Filed: Dec. 15, 2011

(86) PCT No.: PCT/US2011/065253

§ 371 (c)(1), (2), (4) Date: Dec. 13, 2012

(87) PCT Pub. No.: WO2013/089753

PCT Pub. Date: Jun. 20, 2013

(65) Prior Publication Data

US 2013/0175042 A1 Jul. 11, 2013

(51) Int. Cl.

| | |
|---|---|
| ***E21B 43/12*** | (2006.01) |
| ***E21B 41/00*** | (2006.01) |
| ***E21B 34/14*** | (2006.01) |

(52) U.S. Cl.

CPC ..... *E21B 41/0007* (2013.01); *E21B 34/14* (2013.01); *E21B 43/121* (2013.01); *E21B 43/128* (2013.01)

(58) Field of Classification Search

CPC ..... E21B 2034/002; E21B 2034/0058; E21B 34/08; E21B 34/102; E21B 34/101; E21B 43/121; E21B 43/128; E21B 34/14

See application file for complete search history.

(56) References Cited

U.S. PATENT DOCUMENTS 3,731,742 A 5/1973 Sizer et al.
4,191,248 A * 3/1980 Huebsch et al. ..... 166/66.7

(Continued)

FOREIGN PATENT DOCUMENTS

WO 2013089730 6/2013
WO 2013089746 6/2013

OTHER PUBLICATIONS

International Patent Application No. PCT/US2011/065109, "International Search Report and Written Opinion", mailed Aug. 3, 2012, 9 pages.

(Continued)

*Primary Examiner* — Cathleen Hutchins

(74) *Attorney, Agent, or Firm* — Kilpatrick Townsend & Stockton LLP

(57) ABSTRACT

Certain aspects and embodiments of the present invention are directed to a subsurface safety valve disposed in a wellbore through a fluid-producing formation. The subsurface safety valve can include a closure mechanism. In some embodiments, the subsurface safety valve can be coupled with an electric submersible pump. The subsurface safety valve coupled to the electric submersible pump can be positioned in a passageway defined by a tubing string via a power cable coupled to the electric submersible pump. In some embodiments, the subsurface safety valve can include at least one terminal. The at least one terminal can form an electrical connection between the subsurface safety valve and the electric submersible pump. The subsurface safety valve can receive power from the electric submersible pump via the electrical connection.

22 Claims, 7 Drawing Sheets

(56) References Cited

U.S. PATENT DOCUMENTS

| | | | | |
|---|---|---|---|---|
| 4,425,965 | A | 1/1984 | Bayh et al. | |
| 4,440,221 | A * | 4/1984 | Taylor et al. | 166/106 |
| 4,621,689 | A | 11/1986 | Brookbank, III | |
| 4,768,594 | A | 9/1988 | Akkerman | |
| 4,852,648 | A | 8/1989 | Akkerman et al. | |
| 4,880,060 | A | 11/1989 | Schwendemann et al. | |
| 5,070,944 | A | 12/1991 | Hopper | |
| 5,996,687 | A | 12/1999 | Pringle et al. | |
| 6,089,322 | A | 7/2000 | Kelley et al. | |
| 6,227,299 | B1 | 5/2001 | Dennistoun | |
| 6,283,217 | B1 | 9/2001 | Deaton | |
| 6,398,583 | B1 | 6/2002 | Zehren | |
| 6,957,703 | B2 * | 10/2005 | Trott et al. | 166/332.8 |
| 7,624,795 | B1 | 12/2009 | Bangash et al. | |
| 7,798,229 | B2 | 9/2010 | Vick, Jr. et al. | |
| 8,056,621 | B2 | 11/2011 | Ring et al. | |
| 2002/0053426 | A1 | 5/2002 | Kelley et al. | |
| 2003/0234104 | A1 | 12/2003 | Johnston et al. | |
| 2004/0188096 | A1 | 9/2004 | Traylor | |
| 2006/0118307 | A1 | 6/2006 | Williamson et al. | |
| 2007/0187107 | A1 | 8/2007 | Pringle | |
| 2007/0205000 | A1 | 9/2007 | Hosie et al. | |
| 2007/0295504 | A1 | 12/2007 | Patel | |
| 2008/0230231 | A1 | 9/2008 | Bolding et al. | |
| 2010/0108320 | A1 | 5/2010 | Larnach | |
| 2011/0155381 | A1 | 6/2011 | Reaux | |
| 2011/0155392 | A1 | 6/2011 | Frazier | |
| 2011/0247828 | A1 | 10/2011 | Patel et al. | |
| 2012/0199367 | A1 | 8/2012 | Bouldin et al. | |
| 2013/0175025 | A1 | 7/2013 | Vick, Jr. et al. | |
| 2013/0206389 | A1 | 8/2013 | Vick, Jr. et al. | |

OTHER PUBLICATIONS

International Patent Application No. PCT/US2011/065204, "International Search Report and Written Opinion", mailed Sep. 12, 2012, 10 pages.

International Patent Application No. PCT/US2011/065253, "International Search Report and Written Opinion", mailed Sep. 12, 2012, 9 pages.

* cited by examiner

SUBSURFACE SAFETY VALVE DEPLOYABLE VIA ELECTRIC SUBMERSIBLE PUMP

CROSS-REFERENCE TO RELATED APPLICATIONS

This application is a U.S. national phase patent application under 35 U.S.C. 371 of International Patent Application No. PCT/US2011/065253 entitled "Subsurface Safety Valve Deployable Via Electric Submersible Pump," filed Dec. 15, 2011, and is related to International Patent Application No. PCT/US2011/065204 entitled "Integrated Opening Subsystem for Well Closure System," filed Dec. 15, 2011; International Patent Application No. PCT/US2011/065109 entitled "Dual Closure System for Well System," filed Dec. 15, 2011; U.S. patent application Ser. No. 13/703,933 entitled "Integrated Opening Subsystem for Well Closure System," filed Dec. 13, 2012; and U.S. patent application Ser. No. 13/703,963 entitled "Dual Closure System for Well System", filed Dec. 13, 2012; the contents of each of which are incorporated herein by reference in their entirety.

TECHNICAL FIELD OF THE INVENTION

The present invention relates generally to devices for controlling fluid flow in a bore in a subterranean formation and, more particularly (although not necessarily exclusively), to devices that are capable of preventing the production of fluid through a well traversing a subterranean formation.

BACKGROUND

Operating a well, such as an oil or gas well for extracting fluids that can include petroleum oil hydrocarbons from a subterranean formation, can include using closure mechanisms for restricting or preventing the flow of fluids from a hydrocarbon-bearing subterranean formation in which the well is located. Pressure from a hydrocarbon-bearing subterranean formation can cause fluids from the formation to move toward the surface in the absence of a pumping system or other artificial lift system. A closure mechanism can control or prevent the movement of fluids.

Current solutions for deploying a closure mechanism in a well include coupling a mechanically operated closure mechanism, such as a foot valve, to a production tubing section and inserting the production tubing section into the wellbore. A submersible pump can be inserted into the wellbore. The closure mechanism can be operated by inserting a hydraulic control line into the wellbore to open and close the closure mechanism.

Systems and methods are desirable that are usable to deploy a closure mechanism in a well with an electric submersible pump.

SUMMARY

Certain aspects and embodiments of the present invention are directed to a closure system that can be disposed in a wellbore that is through a fluid-producing formation. The closure system can include a subsurface safety valve. The subsurface safety valve can include a closure mechanism and at least one terminal. The closure mechanism can be positioned in a passageway defined by a tubing string. The closure mechanism can prevent a flow of fluid to a portion of the passageway that is closer to a surface of the wellbore than the closure mechanism. The terminal can form an electrical connection between the subsurface safety valve and an electric submersible pump. The subsurface safety valve can receive power from the electric submersible pump via the electrical connection.

Another embodiment is directed to a method for deploying a subsurface safety valve in a wellbore that is through a fluid-producing formation. A subsurface safety valve can be coupled with an electric submersible pump. The subsurface safety valve and the electric submersible pump can be positioned in a passageway defined by a tubing string via a power cable coupled to the electric submersible pump.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
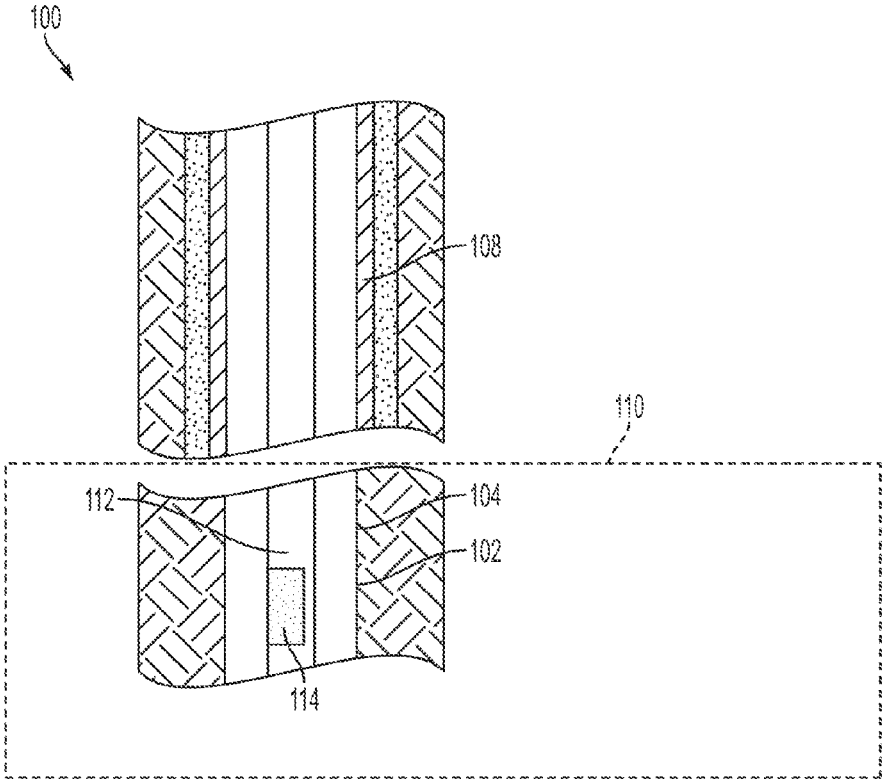
FIG. 1 is a schematic illustration of a well system having a well closure system that can include a subsurface safety valve according to one embodiment of the present invention.

Certain aspects and embodiments of the present invention are directed to a subsurface safety valve that can be disposed in a wellbore that is through a fluid-producing formation. The subsurface safety valve can be coupled to an electric submersible pump. The subsurface safety valve coupled to the electric submersible pump can be deployed into a wellbore by inserting the coupled subsurface safety valve and electric submersible pump into the wellbore via a power cable coupled to the electric submersible pump. The electric submersible pump can be decoupled from the subsurface safety valve. The electric submersible pump can be removed from the wellbore by a retrieval unit using the power cable coupled to the electric submersible pump. A retrieval unit can be a mechanism including a cable for lowering tools into a wellbore. An example of a retrieval unit is a wireline unit.

The subsurface safety valve can include a closure mechanism. The closure mechanism can be any mechanism for permitting fluid to flow or pressure to be communicated in one direction and preventing fluid from flowing or pressure from being communicated in an opposite direction. The closure mechanism can be positioned in a passageway defined by a tubing string. In some embodiments, the subsurface safety valve can include a body configured to be coupled with an electric submersible pump.

In some embodiments, the subsurface safety valve can be an electrical subsurface safety valve. The electric subsurface safety valve can include at least one terminal. The at least one terminal can form an electrical connection between the subsurface safety valve and the electric submersible pump. The electric subsurface safety valve can receive power via the electrical connection with the electric submersible pump. In other embodiments, the subsurface safety valve can be hydraulically operated.

The closure mechanism can be a mechanism for restricting or preventing the flow of fluid from the fluid-producing formation fluid to the surface of the wellbore, such as a valve. The closure mechanism can be set to an open or a closed position via any suitable device, such as (but not limited to) a linear actuator, a long stroke solenoid, or a linear induction motor. The open position can allow a flow of fluid to a portion of the passageway that is closer to a surface of the wellbore than the closure mechanism. The closed position can prevent a flow of fluid to a portion of the passageway that is closer to a surface of the wellbore than the closure mechanism. The device manipulating the closure mechanism can be powered by the electrical power received via the electrical connection.

Examples of closure mechanisms can include (but are not limited to) a flapper valve, a ball valve, or a poppet valve. A flapper valve can include a spring-loaded plate allowing fluids to be pumped in the downhole direction from the surface toward the fluid-producing formation. The flapper valve can close when the flow of fluid is directed toward the surface. A ball valve can include a spherical disc having a port through the middle such that fluids can flow through the ball valve when the port is aligned with both ends of the ball valve. The ball valve can be closed to block the flow of fluids by orienting spherical disc such that the port is perpendicular to the ends of the ball valve. A poppet valve can include a hole and a tapered plug portion, such as a disk shape on the end of a shaft. The shaft guides the plug portion by sliding through a valve guide. A pressure differential can seal the poppet valve.

In additional or alternative embodiments, the subsurface safety valve can include a locking mechanism configured to maintain the closure mechanism in an open position.

Another embodiment is directed to a method for deploying a subsurface safety valve in a wellbore through a fluid-producing formation. A subsurface safety valve can be coupled with an electric submersible pump. The subsurface safety valve and the electric submersible pump can be positioned in a passageway defined by a tubing string via a power cable coupled to the electric submersible pump.

In additional or alternative embodiments, the electric submersible pump can be decoupled from the subsurface safety valve and removed from the wellbore. The subsurface safety valve can remain in the wellbore.

In additional or alternative embodiments, a second electric submersible pump can be inserted into the wellbore. The second electric submersible pump can be coupled to the subsurface safety valve. The second electric submersible pump and the subsurface safety valve can be removed from the wellbore via a power cable coupled to the second electric submersible pump.

In additional or alternative embodiments, the subsurface safety valve coupled to the electric submersible pump can be positioned in the wellbore so as to open a passive closure mechanism coupled to a tubing string in the wellbore. The passive closure mechanism can be mechanically operated. Positioning the subsurface safety valve coupled to the electric submersible pump in the well bore can apply force opening the passive closure mechanism. In some embodiments, the subsurface safety valve coupled to the electric submersible pump can apply force directly to the passive closure mechanism. In other embodiments, the subsurface safety valve coupled to the electric submersible pump can apply force to a sleeve adjacent to the passive closure mechanism. The sleeve can apply force directly to the passive closure mechanism to open the passive closure mechanism.

In additional or alternative embodiments, the subsurface safety valve can include a battery power subsystem. The battery power subsystem can power the subsurface safety valve. For example, an electric submersible pump providing power to the subsurface safety valve can be decoupled from the subsurface safety valve. The subsurface safety valve can operate in the absence of an electric submersible pump in the wellbore using power provided by the battery power subsystem. In some embodiments, the battery power subsystem can be charged using the power received via the at least one terminal when the subsurface safety valve is coupled to an electric submersible pump.

In additional or alternative embodiments, the subsurface safety valve can include an override subsystem. The override subsystem can maintain the subsurface safety valve in an open position during a power failure. In some embodiments, the override can include a motor powered by the battery power subsystem. The motor can apply force opening the subsurface safety valve in response to the communication subsystem receiving a signal directing the override to open the subsurface safety valve. In other embodiments, the override subsystem can include a motor operated using a current from the electric submersible pump. For example, a current operating in a positive direction can operate the electric submersible pump and the current operating in a negative direction can operate the subsurface safety valve, causing the subsurface safety valve to open.

In additional or alternative embodiments, the subsurface safety valve can include a communication subsystem. The communication subsystem can be configured to communicate via a wireless connection. For example, a control system can be located at a rig at the surface. An operator can control the operation of the subsurface safety valve using control signals communicated from the control system to the subsurface safety valve via the communication subsystem.

In additional or alternative embodiments, the subsurface safety valve can include an equalizing subsystem configured to equalize pressure across the closure mechanism. Equalizing the pressure across the closure mechanism can decrease the force applied to set the closure mechanism to an open position. The equalizing subsystem can include, but is not limited to, an unloading pump. An unloading pump can equalize pressure across the closure mechanism by pumping fluid from a portion of the passageway that is further from the surface of the wellbore to a second portion of the passageway that is closer to the surface of the wellbore. The unloading pump can be operated using a pressure differential resulting across the closure mechanism.

In additional or alternative embodiments, a first motor can operate the electric submersible pump and a second motor can operate the subsurface safety valve. In other embodiments, the subsurface safety valve can be operated by the same motor operating the electric submersible pump coupled to the subsurface safety valve. The subsurface safety valve can include gearing and/or clutch mechanisms powered by the motor operating the electric submersible pump.

In additional or alternative embodiments, a control line can be deployed into the passageway defined by the tubing string to control the subsurface safety valve.

In additional or alternative embodiments, the subsurface safety valve can include a two stage closing process to prevent accidental closure of the closure mechanism during the operation of an electric submersible pump coupled to the subsurface safety valve. The first stage can include the subsurface safety valve receiving a signal to close the subsurface safety valve partially. The second stage can include the subsurface safety valve completely closing the subsurface safety valve when the electric submersible pump ceases operation.

In additional or alternative embodiments, the electric submersible pump can include a trigger mechanism to terminate operation of the electric submersible pump upon closure of the subsurface safety valve. Terminating operation of the electric submersible pump can prevent damage to the electric submersible pump caused by the electric submersible pump operating in the absence of fluid within a passageway defined by the tubing string. The trigger mechanism can include, for example, a float switch configured to be in an "on" position by fluid flowing through a passageway defined by the tubing string, allowing operation of the electric submersible pump. Closing the subsurface safety valve can cause fluid to cease flowing through the passageway defined by the tubing string, setting the float switch to an "off" position, terminating operation of the electric submersible pump.

In additional or alternative embodiments, the subsurface safety valve can include a sensor that prevents activation of a trigger mechanism closing the closure mechanism during operation of the electric submersible pump. For example, the sensor can engage a locking mechanism, such as an electromechanical brake, opposing the operation of the trigger mechanism. The locking mechanism can be disengaged by the sensor failing to detect the operation of the electric submersible pump.

In some embodiments, the sensor can detect the operation of the electric submersible pump by detecting current or voltage associated with the operation of one or more components of the electric submersible pump. In other embodiments, the sensor can detect the operation of the electric submersible pump by detecting the sound or flow of fluids resulting from the operation of the electric submersible pump. In other embodiments, the sensor can be activated by a proximity switch.

In additional or alternative embodiments, one or more sensors can monitor performance of the subsurface safety valve or the electric submersible pump.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 schematically depicts a well system 100 with a well closure system 114 that can include a subsurface safety valve according to certain embodiments. The well system 100 includes a wellbore 102 extending through various earth strata. The wellbore 102 has a substantially vertical section 104. The substantially vertical section 104 may include a casing string 108 cemented at an upper portion of the substantially vertical section 104. The substantially vertical section 104 extends through a hydrocarbon-bearing subterranean formation 110.

A tubing string 112 extends from the surface within wellbore 102. The tubing string 112 can define a passageway providing a conduit for production of formation fluids to the surface.

The well closure system 114 is positioned within a passageway defined by the tubing string 112. The well closure system 114 is depicted as functional block in FIG. 1. Pressure from the subterranean formation 110 can cause fluids to flow from the subterranean formation 110 to the surface. The well closure system 114 can include equipment capable of restricting or preventing the production of formation fluids.

Although FIG. 1 depicts the well closure system 114 positioned in the substantially vertical section 104, a well closure system 114 can be located, additionally or alternatively, in a deviated section, such as a substantially horizontal section. In some embodiments, well closure systems 114 can be disposed in wellbores having both a substantially vertical section and a substantially horizontal section. Well closure systems 114 can be disposed in open hole environments, such as is depicted in FIG. 1, or in cased wells.

Figure 2:
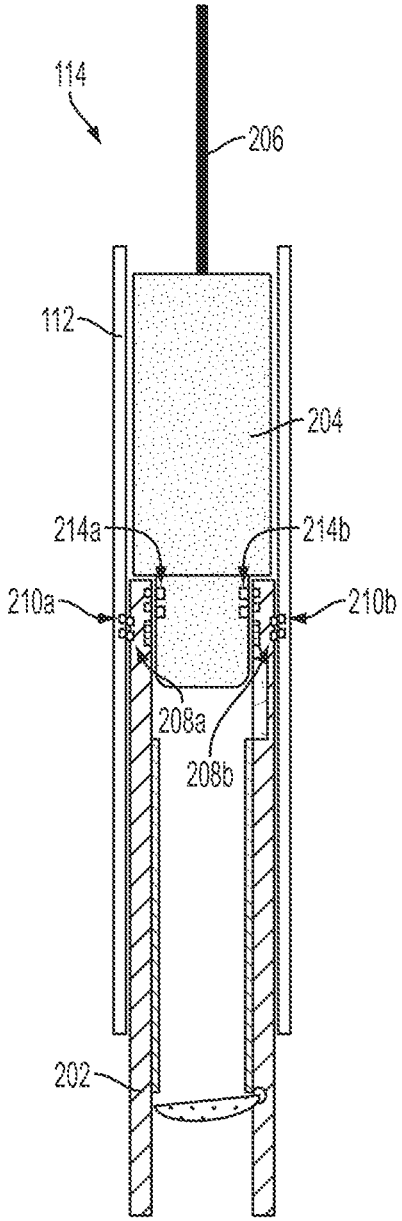
FIG. 2 is a cross-sectional side view of a well closure system including a subsurface safety valve deployable via an electric submersible pump according to one embodiment of the present invention.

FIG. 2 depicts a cross-sectional side view of a well closure system 114 including a subsurface safety valve 202 deployable via an electric submersible pump 204 according to one embodiment.

The subsurface safety valve 202 coupled to the electric submersible pump 204 can be inserted into a passageway defined by the tubing string 112 via a power cable 206 coupled to the electric submersible pump 204. The subsurface safety valve 202 can be coupled to the tubing string 112 by coupling the coupling points 208*a*, 208*b* of the subsurface safety valve 202 to the coupling points 210*a*, 210*b* of the tubing string 112. Coupling the subsurface safety valve 202 to the tubing string 112 can include positioning the subsurface safety valve 202 in the passageway such that a locking mechanism is engaged at coupling points 208*a*, 208*b*, 210*a*, 210*b*.

The electric submersible pump 204 can be an electrically powered downhole pumping system or other artificial lift system for extracting formation fluids from the subterranean formation 110. The electric submersible pump 204 can include several staged centrifugal pump sections customized to the production characteristics and wellbore characteristics of a well. The electric submersible pump 204 can include terminals 214*a*, 214*b*. The electric submersible pump 204 can provide power to the subsurface safety valve via terminals 214*a*, 214*b*. In other embodiments, the electric submersible pump 204 can communicate electrical signals via terminals 214*a*, 214*b*.

In some embodiments, the electric submersible pump 204 can include two or more independent electric submersible pumps coupled together for redundancy.

Figure 3:
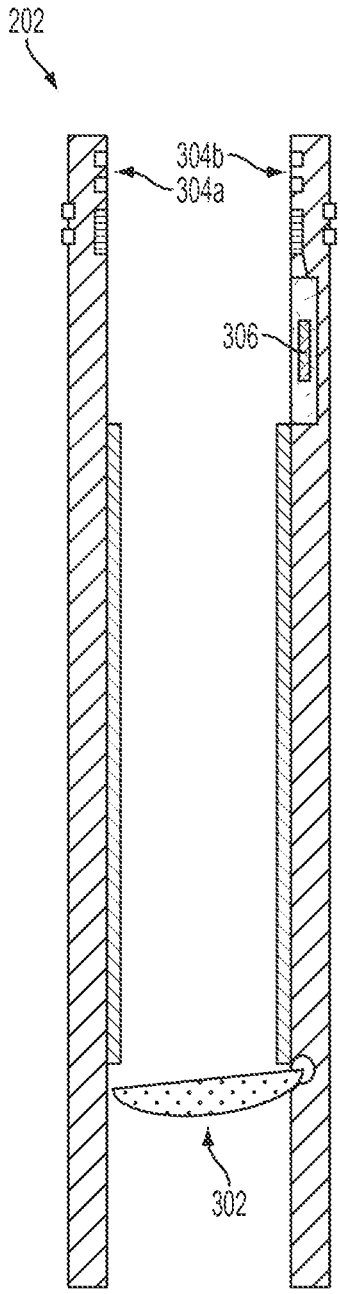
FIG. 3 is a cross-sectional side view of the subsurface safety valve according to one embodiment of the present invention.

FIG. 3 depicts a cross-sectional side view of the subsurface safety valve 202 according to one embodiment. The subsurface safety valve 202 can include a closure mechanism 302, terminals 304*a*, 304*b*, and a locking mechanism 306.

The closure mechanism 302 can be any mechanism for restricting or preventing the flow of fluid or communication of pressure from the fluid-producing formation fluid to the surface of the wellbore 102, such as a valve. The closure mechanism 302 is depicted in FIG. 3 as a flapper valve. Other examples of a closure mechanism 302 can include (but are not limited to) a poppet valve or a ball valve. The closure mechanism 302 can be set to an open or a closed position by any suitable device, such as (but not limited to) a linear actuator, a long stroke solenoid, or a linear induction motor. In some embodiments, the closure mechanism 302 can be cocked by a reverse current applied to the terminals 304*a*, 304*b*.

The terminals 304*a*, 304*b* can be configured to form an electrical connection between the subsurface safety valve 202 and the electric submersible pump 204 to the electric submersible pump 204. The subsurface safety valve 202 can receive power from the electric submersible pump 204 via terminals 304*a*, 304*b*. In other embodiments, the subsurface safety valve 202 can communicate electrical signals via terminals 304*a*, 304*b*.

Although FIGS. 2 and 3 depict a direct electrical connection between the subsurface safety valve 202 and the electric submersible pump 204, other embodiments are possible. In some embodiments, the subsurface safety valve 202 can be coupled at terminals 304*a*, 304*b* to a power cable 206 providing power to the electric submersible pump 204. In other embodiments, the subsurface safety valve 202 can be deployed using the power cable 206 and receive power via a second power cable coupled to the subsurface safety valve 202. In other embodiments, the terminals 304*a*, 304*b* can be conductors inductively coupled to the terminals 214*a*, 214*b*.

In additional or alternative embodiments, a first motor can operate the electric submersible pump 204 and a second motor can operate the subsurface safety valve 202. In other embodiments, the subsurface safety valve 202 can be operated by the same motor operating the electric submersible pump 204. The subsurface safety valve 202 can include gearing or clutch mechanisms powered by the motor operating the electric submersible pump 204.

In some embodiments, the subsurface safety valve 202 can be hydraulically operated. The terminals 304*a*, 304*b* can be omitted. A control line can be deployed into the passageway defined by the tubing string 112 to control the subsurface safety valve 202. In other embodiments, a control line can communicate hydraulic pressure from the electric submersible pump 204 to the subsurface safety valve 202.

In some embodiments, the subsurface safety valve 202 can include a locking mechanism 306. The locking mechanism 306 can maintain the subsurface safety valve 202 in an open position. Examples of a locking mechanism 306 include (but are not limited to) an electro-mechanical brake, such as a crown tooth or friction plate. In another embodiment, the subsurface safety valve 202 can include a solenoid configured to maintain the subsurface safety valve 202 in an open position.

In some embodiments, the subsurface safety valve 202 can include an equalizing subsystem configured to equalize pressure across the closure mechanism 302 of the subsurface safety valve 202. Equalizing the pressure across the closure mechanism 302 of the subsurface safety valve 202 can decrease the force applied to open the subsurface safety valve 202. The equalizing subsystem can include, but is not limited to, an unloading pump. An unloading pump can equalize pressure across the closure mechanism 302 of the subsurface safety valve 202 by pumping fluid from a portion of the passageway that is further from the surface of the wellbore 102 to a second portion of the passageway that is closer to the surface of the wellbore 102. The unloading pump can be operated using a pressure differential across the closure mechanism 302.

FIGS. 4-7 depict the deployment of the subsurface safety valve 202 via the electric submersible pump 204 according to one embodiment. The tubing string 112 defines an interior passageway, which may be an annular space.

Figure 4:
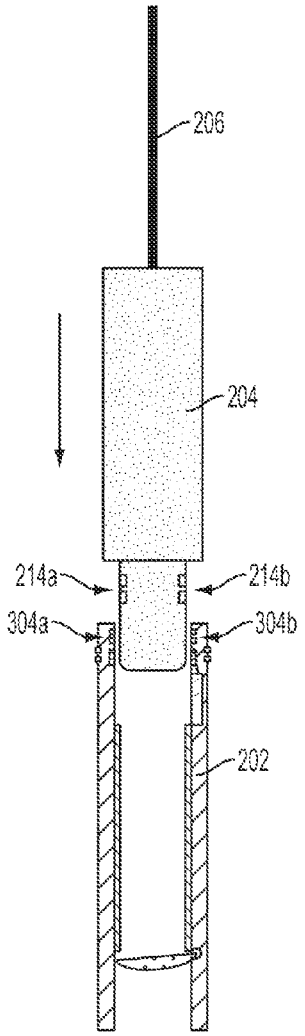
FIG. 4 is a cross-sectional side view of the subsurface safety valve being coupled to the electric submersible pump according to one embodiment of the present invention.

The electric submersible pump 204 can be coupled to the subsurface safety valve 202, as depicted in FIG. 4. The electric submersible pump 204 can be inserted into the subsurface safety valve 202, as depicted by the downward arrow. The subsurface safety valve 202 and the electric submersible pump 204 can be coupled via any suitable coupling mechanism. The subsurface safety valve 202 and the electric submersible pump 204 can be coupled such that the terminals 304*a*, 304*b* of the subsurface safety valve 202 respectively contact the terminals 214*a*, 214*b* of the electric submersible pump 204.

Although the electric submersible pump 204 is depicted in FIG. 4 as being lowered into the subsurface safety valve 202, any suitable orientation and direction of motion for the subsurface safety valve 202 and the electric submersible pump 204 can be used. For example, a subsurface safety valve 202 can be configured such that the subsurface safety valve 202 is inserted into the electric submersible pump 204.

Figure 5:
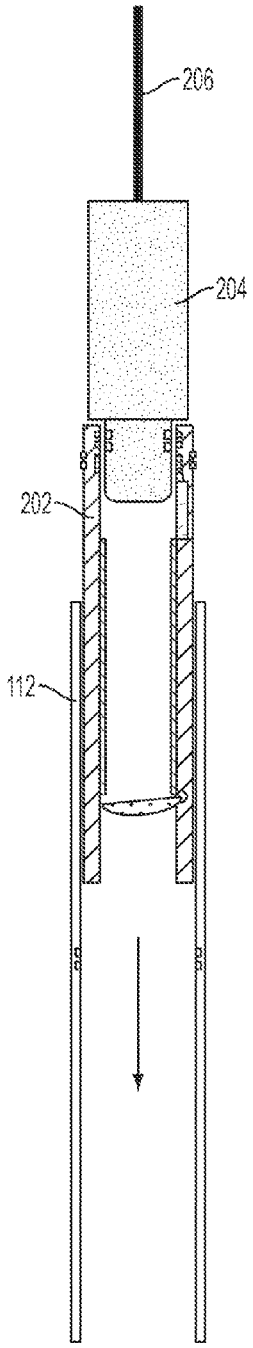
FIG. 5 is a cross-sectional side view of the subsurface safety valve coupled to the electric submersible pump being deployed in a well system according to one embodiment of the present invention.
Figure 6:
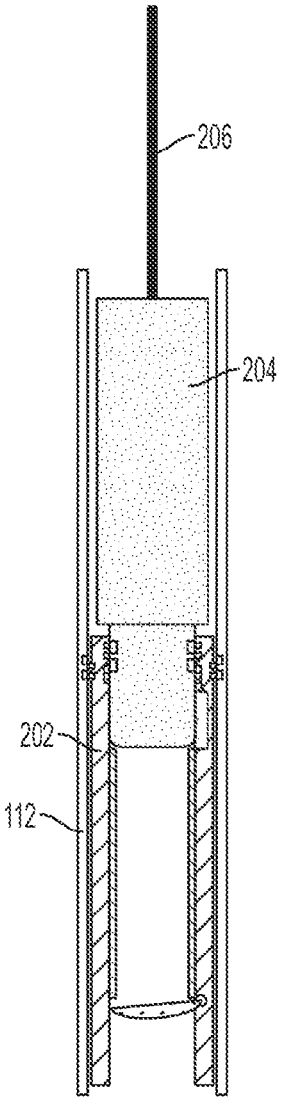
FIG. 6 is a cross-sectional side view of the subsurface safety valve coupled to the electric submersible pump deployed in the well system according to one embodiment of the present invention.

As depicted in FIGS. 5, 6, the coupled subsurface safety valve 202 and electric submersible pump 204 can be inserted in the passageway defined by the tubing string 112 via a power cable 206 coupled to the electric submersible pump 204. The coupled subsurface safety valve 202 and electric submersible pump 204 can be inserted by a retrieval unit. Although FIG. 5 depicts the coupled subsurface safety valve 202 and electric submersible pump 204 as being lowered into the passageway, any suitable orientation and direction of motion for the coupled subsurface safety valve 202 and electric submersible pump 204 can be used.

Figure 7:
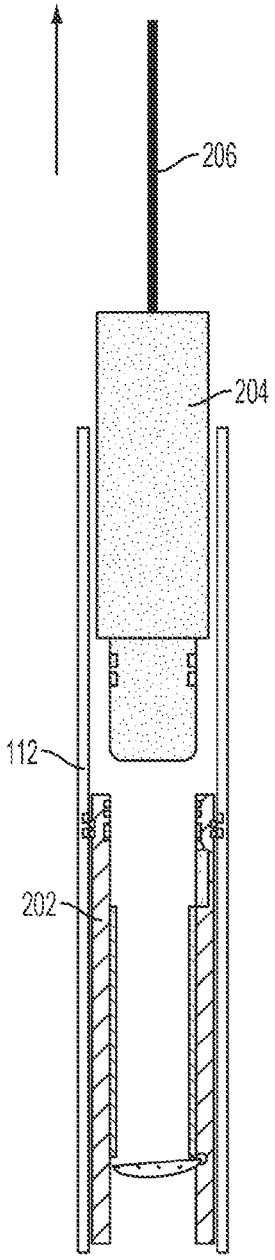
FIG. 7 is a cross-sectional side view of the subsurface safety valve being decoupled from the electric submersible pump according to one embodiment of the present invention.

The subsurface safety valve 202 can be decoupled from the electric submersible pump 204 and remain in the passageway defined by the tubing string 112, as depicted in FIG. 7. Decoupling the subsurface safety valve 202 from the tubing string 112 can include positioning the electric submersible pump 204 such that the coupling mechanism is disengaged. The electric submersible pump 204 can be removed from the passageway by a retrieval unit using the power cable 206 coupled to the electric submersible pump 204.

Although FIG. 7 depicts the electric submersible pump 204 as being raised from the passageway, any suitable orientation and direction of motion for the electric submersible pump 204 can be used.

Although FIGS. 5-7 depict deploying the subsurface safety valve 202 using the electric submersible pump 204, other means for deploying the subsurface safety valve 202 can be used. For example, a subsurface safety valve can be deployed via a running tool separate from an electric submersible pump.

Figure 8:
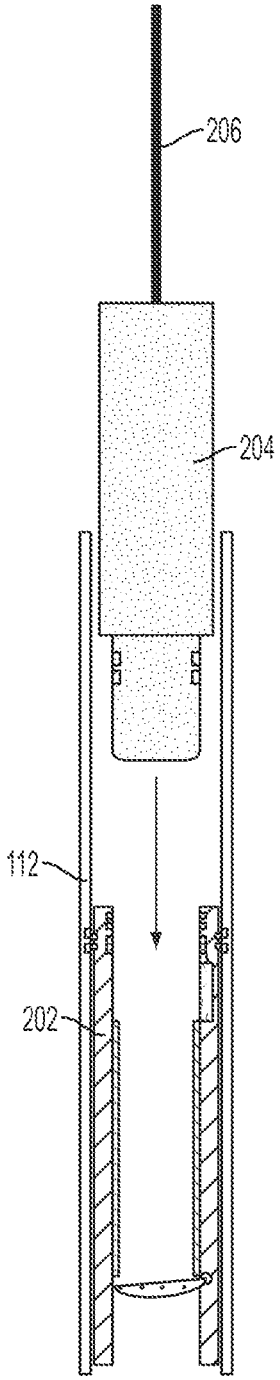
FIG. 8 is a cross-sectional side view of an electric submersible pump being deployed in a well system having a subsurface safety valve according to one embodiment of the present invention.
Figure 9:
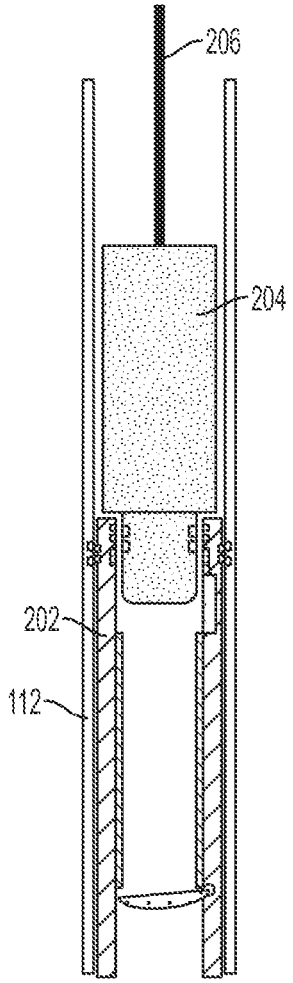
FIG. 9 is a cross-sectional side view of the subsurface safety valve being coupled to the electric submersible pump deployed in a well system according to one embodiment of the present invention.
Figure 10:
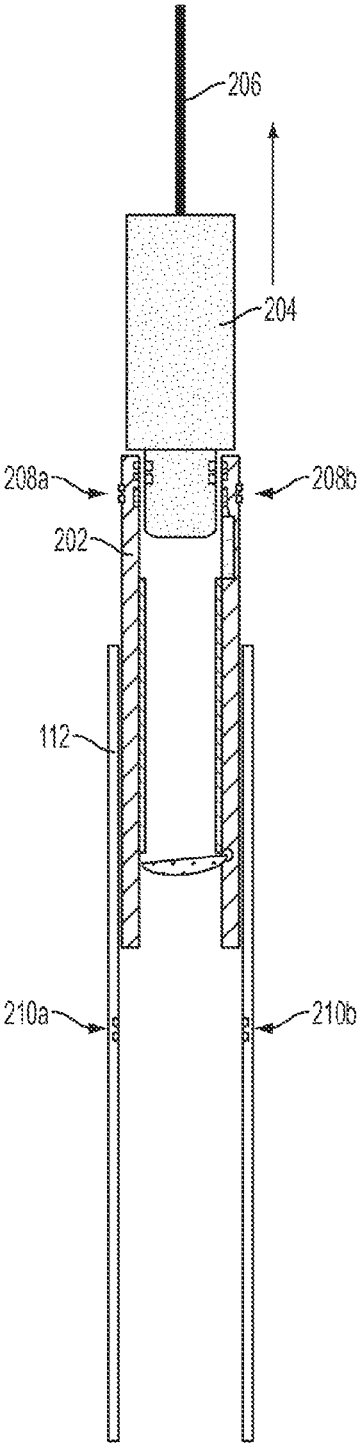
FIG. 10 is a cross-sectional side view of a subsurface safety valve coupled to an electric submersible pump being retrieved from a well system according to one embodiment of the present invention.

FIGS. 8-10 are cross-sectional side views illustrating the retrieval of the subsurface safety valve 202 via the electric submersible pump 204 according to one embodiment.

As depicted in FIG. 8, the electric submersible pump 204 can be inserted in the passageway defined by the tubing string 112 via the power cable 206 coupled to the electric submersible pump 204. A retrieval unit can insert the electric submersible pump 204 into the passageway defined by the tubing string 112.

Although FIG. 8 depicts the electric submersible pump 204 as being lowered into the passageway, any suitable orientation and direction of motion for the electric submersible pump 204 can be used.

As depicted in FIG. 9, the electric submersible pump 204 can be coupled to the subsurface safety valve 202. The subsurface safety valve 202 and the electric submersible pump 204 can be coupled via any suitable coupling mechanism.

As depicted in FIG. 10, the coupled subsurface safety valve 202 and electric submersible pump 204 can be removed from passageway defined by the tubing string 112 via the power cable 206 coupled to the electric submersible pump 204. The subsurface safety valve 202 can be decoupled from the tubing string 112. Decoupling the subsurface safety valve 202 from the tubing string 112 can include positioning the coupled subsurface safety valve 202 and electric submersible pump 204 in the passageway so as to disengage the locking mechanism coupling the subsurface safety valve 202 to the tubing string 112 at coupling points 208*a*, 208*b*, 210*a*, 210*b*. A retrieval unit can remove the coupled subsurface safety valve 202 and electric submersible pump 204 from the passageway.

In some embodiments, the same electric submersible pump 204 depicted can be used to deploy and retrieve the subsurface safety valve 202. In other embodiments, a first electric submersible pump 204 can be used to deploy the subsurface safety valve 202 and a second electric submersible pump 204 can be used to retrieve the subsurface safety valve 202. In other embodiments, the decoupling of the coupled subsurface safety valve 202 and electric submersible pump 204 depicted in FIG. 6 and the coupling of the electric submersible pump 204 and the subsurface safety valve 202 depicted in FIG. 8 can be omitted.

Although FIG. 10 depicts the coupled subsurface safety valve 202 and electric submersible pump 204 as being raised from the passageway, any suitable orientation and direction of motion for the coupled subsurface safety valve 202 and electric submersible pump 204 can be used.

Although FIGS. 8-10 depict retrieving the subsurface safety valve 202 using the electric submersible pump 204, other means for retrieving the subsurface safety valve 202 can be used. For example, a subsurface safety valve can be retrieved via a retrieval tool separate from an electric submersible pump. A retrieval tool can be deployed into the passageway in the same manner as the electric submersible pump 204 depicted in FIGS. 8-10. The retrieval tool can be coupled to the subsurface safety valve. The subsurface safety valve can be retrieved from the passageway via the retrieval tool.

Figure 11:
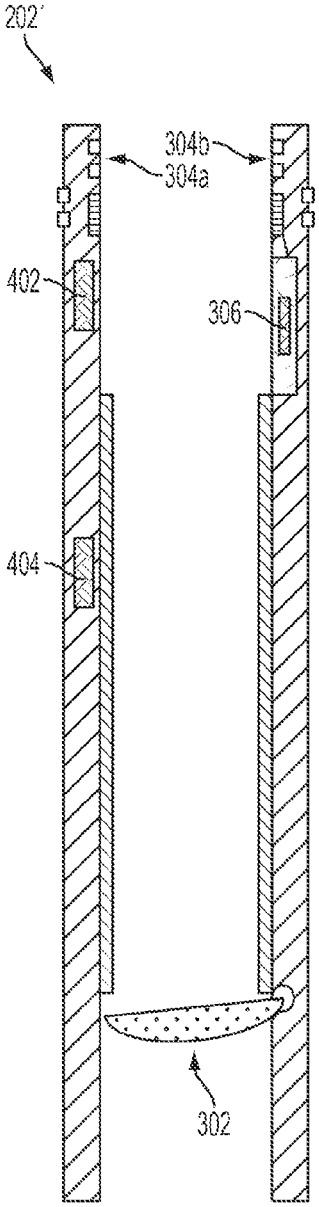
FIG. 11 is a cross-sectional side view of a subsurface safety valve having additional control features according to one embodiment of the present invention.

FIG. 11 depicts a cross-sectional side view of a subsurface safety valve 202' having additional control features according to one embodiment. The subsurface safety valve 202' can include a communication subsystem 402 and an override subsystem 404.

The communication subsystem 402 can include any suitable device for communicating signals between the subsurface safety valve and another system. In some embodiments, the communication subsystem 402 can communicate wirelessly with a control system at a rig located at the surface. In another embodiment, when the electric submersible pump 204 is joined with the subsurface safety valve 202 can communicate via the communication subsystem 402 and a second communication subsystem disposed in the electric submersible pump 204. For example, a control system can be located at a rig at the surface. An operator can control the operation of the subsurface safety valve 202 using control signals communicated from the control system to the subsurface safety valve via the communication subsystem 402. Communicating via a battery-powered, wireless communication subsystem 402 can allow an operator to control the subsurface safety valve 202 without the electric submersible pump 204 being positioned in the passageway defined by the tubing string 112.

The override subsystem 404 can open a subsurface safety valve 202 that has been closed by a fail-safe mechanism during a power failure. The override subsystem 404 can maintain the subsurface safety valve 202 in an open position during a power failure. In some embodiments, the override subsystem 404 can include a motor powered by the battery power subsystem. The motor can apply force opening the subsurface safety valve 202 in response to the communication subsystem 402 receiving a signal directing the override to open the subsurface safety valve 202. In other embodiments, the override subsystem 404 can communicate a signal to the electric submersible pump 204 coupled to the subsurface safety valve 202, causing the electric submersible pump 204 to reverse the flow direction of the electric submersible pump 204 such that pressure from the electric submersible pump forces open the subsurface safety valve 202. In other embodiments, the override subsystem 404 can include a motor operated using a current from the electric submersible pump 204. For example, a current operating in a positive direction can operate the electric submersible pump 204 and the current operating in a negative direction can operate the subsurface safety valve 202, causing the subsurface safety valve 202 to open.

In additional or alternative embodiments, a trigger mechanism can terminate operation of the electric submersible pump 204 upon closure of the subsurface safety valve 202. Terminating operation of the electric submersible pump 204 can prevent damage to the electric submersible pump 204 caused by the electric submersible pump 204 operating in the absence of fluid within a passageway defined by the tubing string. The trigger mechanism can include, for example, a float switch. The float switch can be set to or maintained in an "on" position to allow operation of the electric submersible pump 204 by fluid flowing through the tubing string 112. Closing the subsurface safety valve 202 can cause fluid to cease flowing through the passageway defined by the tubing string 112, setting the float switch to an "off" position to terminate operation of the electric submersible pump 204.

An additional feature relates to preventing accidental closure during the pumping of the electric submersible pump 204. One example of such a feature is a two-stage safety valve included in the subsurface safety valve 202. A signal can be transmitted to partially close the safety valve. The subsurface safety valve 202 can be completely closed when the subsurface safety valve 202 stops pumping. Another example of such a feature is a sensor that prevents activation of a trigger mechanism closing the subsurface safety valve 202. The sensor can be activated via current, voltage, flow, sound, or proximity switch.

In additional or alternative embodiments, one or more sensors can monitor the performance of the electric submersible pump 204 and/or the subsurface safety valve 202. Monitoring the performance of the electric submersible pump 204 can include monitoring the flow of production fluids. Monitoring the performance of the subsurface safety valve 202 can include monitoring the pressure above and/or below the subsurface safety valve 202.

In additional or alternative embodiments, the subsurface safety valve 202 coupled to the electric submersible pump 204 can be positioned in the wellbore 102 so as to open a passive closure mechanism coupled to a tubing string 112 in the wellbore 102. The passive closure mechanism can be mechanically operated. Positioning the subsurface safety valve 202 coupled to the electric submersible pump 204 in the wellbore 102 can apply force opening the passive closure mechanism. Such embodiments are described in detail in PCT/US2011/065109, entitled "Dual Closure System for Well System," incorporated by reference herein. In some embodiments, the subsurface safety valve 202 coupled to the electric submersible pump 204 can apply force directly to the passive closure mechanism. In other embodiments, the subsurface safety valve 202 coupled to the electric submersible pump 204 can apply force to a sleeve adjacent to the passive closure mechanism. The sleeve can apply force directly to the passive closure mechanism to open the passive closure mechanism.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A closure system configured for being disposed in a wellbore through a fluid-producing formation, the closure system having a subsurface safety valve comprising:

a closure mechanism configured to be positioned in a passageway defined by a tubing string, wherein the closure mechanism is configured to prevent a flow of fluid to a portion of the passageway that is closer to a surface of the wellbore than the closure mechanism;

a first coupling mechanism configured for selectively coupling and decoupling the subsurface safety valve with an electric submersible pump;

a second coupling mechanism configured for coupling the surface safety valve to the tubing string separately from the electric submersible pump; and at least one terminal configured to form an electrical connection between the subsurface safety valve and an electric submersible pump, wherein the subsurface safety valve is configured to receive power via the electrical connection.

2. The closure system of claim 1, wherein the subsurface safety valve further comprises a communication subsystem.

3. The closure system of claim 2, wherein the communication subsystem is configured to communicate one or more signals via a wireless connection.

4. The closure system of claim 1, wherein the closure mechanism comprises at least one of a flapper valve, a ball valve, or a poppet valve.

5. The closure system of claim 1, wherein the subsurface safety valve further comprises a locking mechanism configured to maintain the closure mechanism in an open position.

6. The closure system of claim 1, further comprising an override, the override configured to maintain the subsurface safety valve in an open position during a power failure.

7. The closure system of claim 1, further comprising the electric submersible pump coupled to the subsurface safety valve, wherein the subsurface safety valve coupled to the electric submersible pump is configured to be positioned in the passageway defined by the tubing string via a power cable coupled to the electric submersible pump.

8. A method for deploying a subsurface safety valve in a wellbore through a fluid-producing formation, the method comprising:

coupling the subsurface safety valve with an electric submersible pump;

positioning the subsurface safety valve and the electric submersible pump in a passageway defined by a tubing string via a power cable coupled to the electric submersible pump;

decoupling the electric submersible pump from the subsurface safety valve;

removing the electric submersible pump from the wellbore;

inserting a second electric submersible pump into the wellbore; and coupling the second electric submersible pump to the subsurface safety valve.

9. The method of claim 8, further comprising providing electrical power to the subsurface safety valve via an electrical connection between a first terminal of the subsurface safety valve and a second terminal of the electric submersible pump.

10. The method of claim 8, further comprising removing the second electric submersible pump and the subsurface safety valve from the wellbore via a second cable coupled to the second electric submersible pump.

11. The method of claim 8, further comprising removing the subsurface safety valve from the wellbore via a retrieval tool coupled to the subsurface safety valve.

12. A closure system configured for being disposed in a wellbore through a fluid-producing formation, the closure system comprising:

an electric submersible pump; and a subsurface safety valve coupled to the electric submersible pump, wherein the subsurface safety valve comprises:

a first coupling mechanism configured for selectively coupling and decoupling the subsurface safety valve with the electric submersible pump, and a second coupling mechanism configured for coupling the surface safety valve to a tubing string separately from the electric submersible pump;

wherein the subsurface safety valve coupled to the electric submersible pump is configured to be positioned in a passageway defined by the tubing string via a power cable coupled to the electric submersible pump.

13. The closure system of claim 12, wherein the subsurface safety valve comprises an electric subsurface safety valve, the electric subsurface safety valve comprising at least one terminal configured to form an electrical connection between the electric subsurface safety valve and the electric submersible pump, wherein the subsurface safety valve is configured to receive power from the electric submersible pump via the electrical connection.

14. The closure system of claim 13, wherein the subsurface safety valve further comprises a closure mechanism configured to be positioned in the passageway defined by the tubing string, wherein the closure mechanism is configured to prevent a flow of fluid to a portion of the passageway that is closer to a surface of the wellbore than the closure mechanism.

15. The closure system of claim 12, wherein the subsurface safety valve comprises an electric subsurface safety valve, the electric subsurface safety valve comprising at least one terminal configured to form an electrical connection between the electric subsurface safety valve and the power cable, wherein the electric subsurface safety valve is configured to receive power from the power cable via the electrical connection.

16. The closure system of claim 12, wherein the subsurface safety valve comprises an electric subsurface safety valve, the electric subsurface safety valve comprising at least one ter minal configured to form an electrical connection between the electric subsurface safety valve and a second power cable, wherein the electric subsurface safety valve is configured to receive power from the second power cable via the electrical connection.

17. The closure system of claim 12, wherein the subsurface safety valve comprises a hydraulically powered subsurface safety valve.

18. The closure system of claim 12, wherein the subsurface safety valve is configured to be retrieved from the passageway defined by the tubing string via the power cable coupled to the electric submersible pump.

19. The closure system of claim 12, wherein the electric submersible pump is configured to be decoupled from the subsurface safety valve.

20. The closure system of claim 19, wherein the subsurface safety valve is configured to be retrieved from the passageway defined by the tubing string via a retrieval tool coupled to the subsurface safety valve.

21. The closure system of claim 12, further comprising:

a passive closure mechanism coupled to the tubing string, wherein the passive closure mechanism is configured to be in a closed position that prevents a flow of fluid to a portion of the passageway that is closer to a surface of the wellbore than the passive closure mechanism in the absence of the subsurface safety valve in the passageway;

wherein the subsurface safety valve is configured to be positioned in the passageway of the tubing string such that the subsurface safety valve causes the passive closure mechanism to be in an open position that allows the flow of fluid to a second portion of the passageway that is closer to the surface of the wellbore than the passive closure mechanism.

22. The closure system of claim 21, further comprising a spring-loaded sleeve, wherein the subsurface safety valve is configured to be positioned in the passageway so as to cause the spring-loaded sleeve to apply a force setting the passive closure mechanism to the open position.

* * * * *